US009603766B2

(12) United States Patent
Mitchell

(10) Patent No.: US 9,603,766 B2
(45) Date of Patent: Mar. 28, 2017

(54) CASKETS OR COFFINS

(71) Applicant: DEPARTURE LOUNGE COFFINS LIMITED, Auckland (NZ)

(72) Inventor: Andrew Paul Mitchell, Taupiri (NZ)

(73) Assignee: DEPARTURE LOUNGE CASKETS LIMITED (NZ)

( * ) Notice: Subject to any disclaimer, the term of this patent is extended or adjusted under 35 U.S.C. 154(b) by 51 days.

(21) Appl. No.: 14/409,491

(22) PCT Filed: Jul. 18, 2013

(86) PCT No.: PCT/IB2013/055895

§ 371 (c)(1),
(2) Date: Dec. 19, 2014

(87) PCT Pub. No.: WO2014/016738

PCT Pub. Date: Jan. 30, 2014

(65) Prior Publication Data

US 2015/0173989 A1 Jun. 25, 2015

(30) Foreign Application Priority Data

| | | |
|---|---|---|
| Jul. 26, 2012 | (NZ) | 600884 |
| Sep. 28, 2012 | (NZ) | 602709 |
| Jul. 17, 2013 | (NZ) | 613350 |

(51) Int. Cl.
*A61G 17/007* (2006.01)
*A61G 17/00* (2006.01)
(Continued)

(52) U.S. Cl.
CPC ..... *A61G 17/007* (2013.01); *A61G 17/00* (2013.01); *A61G 17/004* (2016.11); *B65D 9/12* (2013.01); *B65D 9/34* (2013.01)

(58) Field of Classification Search
CPC ..... A61G 17/00; A61G 17/007; A61G 2017/004; A61G 17/004; A61G 17/0073;
(Continued)

(56) References Cited

U.S. PATENT DOCUMENTS 1,373,730 A * 4/1921 Hollins ..... A61G 17/00 27/2
1,610,781 A * 12/1926 Hollins ..... A61G 17/00 27/4

(Continued)

FOREIGN PATENT DOCUMENTS

| | | |
|---|---|---|
| CA | 1110432 | 10/1981 |
| GB | 251209 | 4/1926 |

*Primary Examiner* — William Miller
(74) *Attorney, Agent, or Firm* — Galbreath Law Offices, P.C.; John A. Galbreath

(57) ABSTRACT

A coffin or container that can be erected or assembled from a substantially knock down or flat state, which includes:—a primary tension panel;—a pair of side panels; and—a pair of end panels; wherein, in an assembled form, an end of each said side panel is releasably attached to each end panel via complementary engaging features on each side panel to define a substantially quadrilateral wall, such that said primary tension panel, when located substantially within said wall, places at least said side panels in tension to thereby retain said primary tension panel within said wall and define, at least in part, a cavity.

17 Claims, 7 Drawing Sheets

(51) Int. Cl.
*B65D 6/16* (2006.01)
*B65D 6/34* (2006.01)

(58) Field of Classification Search
CPC ... B65D 9/34; B65D 9/32; B65D 9/12; B65D 9/02
USPC ..... 27/2, 4; 217/65; 220/4.28
See application file for complete search history.

(56) References Cited

U.S. PATENT DOCUMENTS

| | | | | |
|---|---|---|---|---|
| 4,800,631 | A * | 1/1989 | Pellmann | A61G 17/007 27/2 |
| 6,018,853 | A * | 2/2000 | Chen | A61G 17/00 220/4.28 |
| 6,314,626 | B1 * | 11/2001 | Becker | A61G 17/00 217/13 |
| 6,497,018 | B1 * | 12/2002 | Chiu | A61G 17/00 220/4.28 |
| 7,222,400 | B2 * | 5/2007 | Leverett | A61G 17/00 27/19 |
| 7,263,751 | B2 | 9/2007 | Davis | |
| 7,761,963 | B2 | 7/2010 | Koch | |
| 8,443,496 | B2 * | 5/2013 | De La Fuente | A61G 17/00 16/424 |
| 8,584,327 | B1 * | 11/2013 | Kodak | A61G 17/0076 220/4.28 |
| 2010/0263177 | A1 | 10/2010 | Abayhan | |

* cited by examiner

CASKETS OR COFFINS

TECHNICAL FIELD OF THE INVENTION

The present invention relates to containers and more particularly caskets and coffins.

In particular, though not solely, the present invention is directed at containers, caskets and coffins that are assembled from flat panel components by hand, or with minimum tools, that require no fasteners or adhesives.

This document includes by reference all of the material disclosed in New Zealand Provisional Patent applications 600884 and 602709

BACKGROUND OF THE INVENTION

Coffins traditionally have been made from wooden materials using skills and techniques similar to cabinet making. However such coffins are often very expensive and time consuming to make. They also use expensive materials that also take some time to decompose when buried and may contain toxic materials.

When such coffins are cremated they may also take a significant time to burn to the desired ash consistency and may also release toxic chemical or undesirable products.

Increasingly there are coffins available with a more ecologically friendly build, both in materials and time taken to construct. For example, coffins made from cardboard, and similar products, are available. However these, even when coated, may not cope very well with moisture and may lack robustness. Some cardboard coffins have issues when cremated as they do not of themselves collapse to a fine ash, but rather they retain their shape even in a fully combusted state. This can create issues for handling and returning the ashes.

Further a number of ecologically sound coffins available cannot be rapidly manufactured should there be a sudden demand, for example a natural disaster.

Further typically coffins that are available take up significant space and they are manufactured, shipped and stored in a ready to use condition. Coffins typically have required the use of fasteners, adhesives and or metallic components.

Other coffins of flat pack construction require tools to enable their assembly.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved container or coffin, or to overcome one of the shortcomings mentioned above, or to at least provide the public with a useful choice.

BRIEF DESCRIPTION OF THE INVENTION

The present invention provides a coffin or container that can be erected or assembled from a substantially knock down or flat state, which includes: — a primary tension panel;

a pair of side panels; and a pair of end panels;

wherein, in an assembled form, an end of each said side panel is releasably attached to each end panel via complementary engaging features on each side panel to define a substantially quadrilateral wall, such that said primary tension panel, when located substantially within said wall, places at least said side panels in tension to thereby retain said primary tension panel within said wall and define, at least in part, a cavity.

Preferably the primary tension panel includes two primary tension panel sides configured to apply the tension to the side panels. Preferably said primary tension panel sides are convex curves.

Preferably said primary tension panel is located close to, and approximately aligned with, a primary tension edge of each side panel, where the primary tension edge of each side panel is located on a first face of the coffin or container.

Preferably each engaging feature passes through an end panel aperture, where each end panel aperture is an aperture through the associated end panel. Preferably each end panel aperture is essentially rectangular. Preferably each engaging feature includes a locking aperture. Preferably each engaging feature is releasably held in place by a locking means which passes through one or more locking apertures. Preferably one or more of the locking means includes a tapered section. Preferably the or each engaging feature is a hook or a tab, where the locking aperture is either a rectangular aperture through the associated tab or an open section of the hook commencing at a throat of the hook and finishing at an exposed surface of the hook. In an alternative preferred form one of the locking apertures engages with a complementary feature in or on the end panel.

Preferably the coffin or box includes a unitary secondary tension panel or a split secondary tension panel. Preferably the split secondary tension panel includes at least a first secondary tension panel and a second secondary tension panel which, when butted up against one another, are essentially the same shape as a unitary secondary tension panel. Preferably said secondary tension panel, when located substantially within said wall, places at least said side panels in tension to thereby retain said secondary tension panel within said wall and act as a full or partial lid, cover or door for said cavity.

Preferably the secondary tension panel includes two secondary tension panel sides configured to apply the tension to the side panels. Preferably said secondary tension panel sides are convex curves.

Preferably said secondary tension panel is located close to, and is approximately aligned with, a secondary tension edge of each side panel, where the secondary tension edge of each side panel is located on a second face of the coffin or container; where the second face is the face of the coffin or container opposite the first face.

Preferably the amount of tension applied by a tension panel is determined by the following formula:

$$\%\ \text{tension}=((W-\underline{w})/L)\times 100\%$$

where

W=a width of the tension panel at a widest part of the tension panel;

$\underline{w}$=a distance between a pair of straight lines at the same location as W, where each straight line joins lengthwise adjacent vertices of the tension panel;

L=a length of the tension panel;

% tension=1% to 18%.

Preferably the widest point (W) of the primary tension panel or unitary secondary tension panel is located at or between 25% and 75% of the length of the tension panel.

Preferably each side panel includes a primary tension panel support for the primary tension panel. Preferably each side panel also includes a secondary tension panel support for the or each secondary tension panel.

Preferably the tension panel support is a groove or channel cut into an inner surface of the side panel. Preferably the depth of the groove is less than 50% of the thickness of the side panel. Preferably the tension panel support includes or is a plurality of shelves.

Preferably each primary tension edge includes apertures dimensioned and configured to accept lifting forks or slings.

Preferably attached to an outer surface of a lowermost face of the coffin or container there is a plurality of bearing strips.

Preferably the second secondary tension panel includes a support shelf configured to support the first secondary tension panel.

The present invention also includes a method of making a container or coffin which includes the following steps:

- construct an essentially quadrilateral wall from a pair of end panels and a pair of side panels;
- insert a first primary tension side of a primary tension panel into a matching primary tension panel support in a first side panel;
- push a second primary tension panel side of the primary tension panel into a matching primary tension panel support in a second side panel deforming each side panel and applying tension to at least the side panels.

Preferably the method also includes the following steps:

- insert a first secondary tension side of a first secondary tension panel into a matching secondary tension panel support in the first side panel;
- insert a second secondary side of the first secondary tension panel into a matching secondary tension panel support in the second side panel and move the first secondary tension panel until it is in contact with an edge of an end panel.

Preferably the method also includes the following steps:

- rest a second secondary tension panel against a support shelf on the first secondary tension panel and insert a first secondary tension side of the second secondary tension panel into a matching secondary tension panel support in the first side panel;
- insert a second secondary side of the second secondary tension panel into a matching secondary tension panel support in the second side panel and move the second secondary tension panel until it is in contact with the first secondary tension panel.

BRIEF DESCRIPTION OF THE DRAWINGS

By way of example only a preferred embodiment of the invention is described in detail with reference to the accompanying drawings in which.

The foregoing description of the invention includes preferred forms thereof. Modifications may be made thereto without departing from the scope of the invention.

DEFINITIONS

Container: a hollow body which has six faces, one of which may be open. Any or all of the faces, prior to assembly, may have curved edges. The hollow body has one pair of opposing sides that are curved.

Quadrilateral: Four sided figure with four interconnected straight or curved sides, such that each curved side is essentially concave or convex.

Trapezium: Quadrilateral with one pair of sides parallel.

DETAILED DESCRIPTION OF THE INVENTION

The invention will be described with particular reference to a coffin (1) however the invention can be applied to any container, where a container is an essentially hollow body with six faces one of which may be open.

Figure 1:
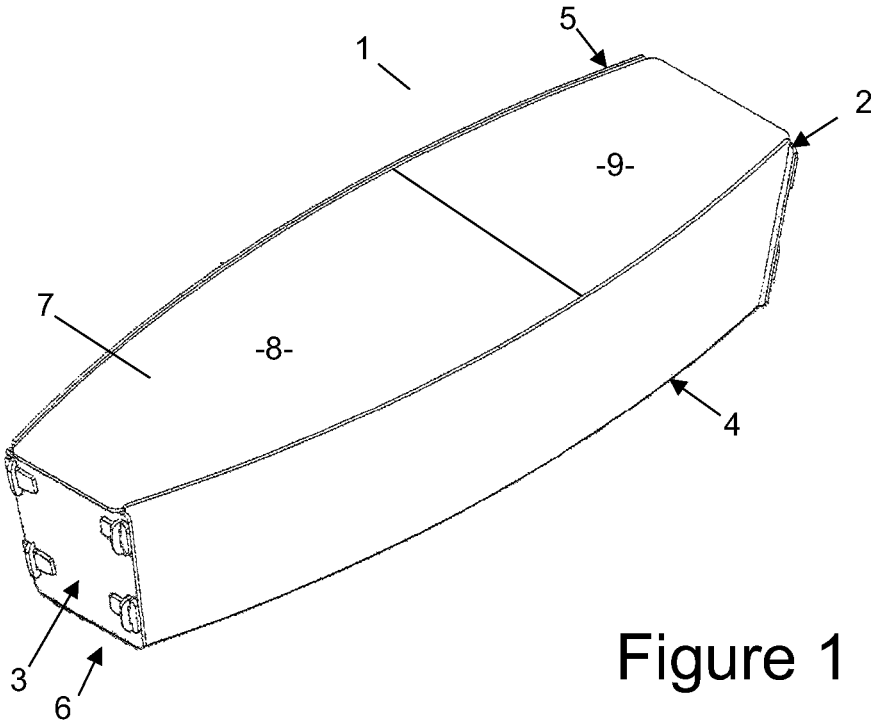
FIG. 1 is a pictorial view of a coffin with a two part secondary tension panel without forklift apertures.
Figure 2:
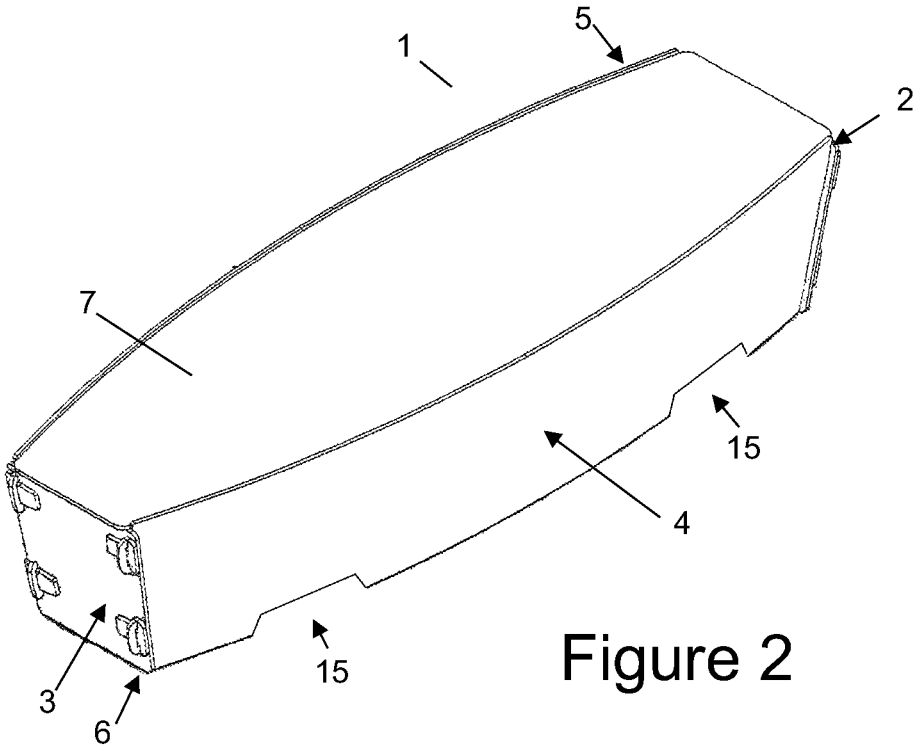
FIG. 2 is a pictorial view of a coffin with a unitary secondary tension panel and fork lift apertures.

Referring to FIGS. 1 and 2 a first and second embodiment of a coffin (1) including two end panels (2,3), two side panels (4,5) a primary tension panel (6) and a secondary tension panel (7) are shown. In FIG. 1 the secondary tension panel (7) is shown as two pieces, a first secondary tension panel (8) and a second secondary tension panel (9). The end panels (2,3) in combination with the side panels (4,5) and primary tension panel (6) form a cavity (10) (see FIG. 11) and, when in place, the secondary tension panel(s) (7,8,9) act as a lid or sealing panel(s) for the cavity (10).

The second embodiment shown in FIG. 2 includes recesses (15) in the lowermost peripheral edge of the side panels which allow access to the underneath of the coffin (1). Such access can be used for lifting by hand or by other means such as machinery for example a forklift. These recesses do not expose the cavity or the primary tension panel (6), though for some containers this may be desirable.

Figure 3:
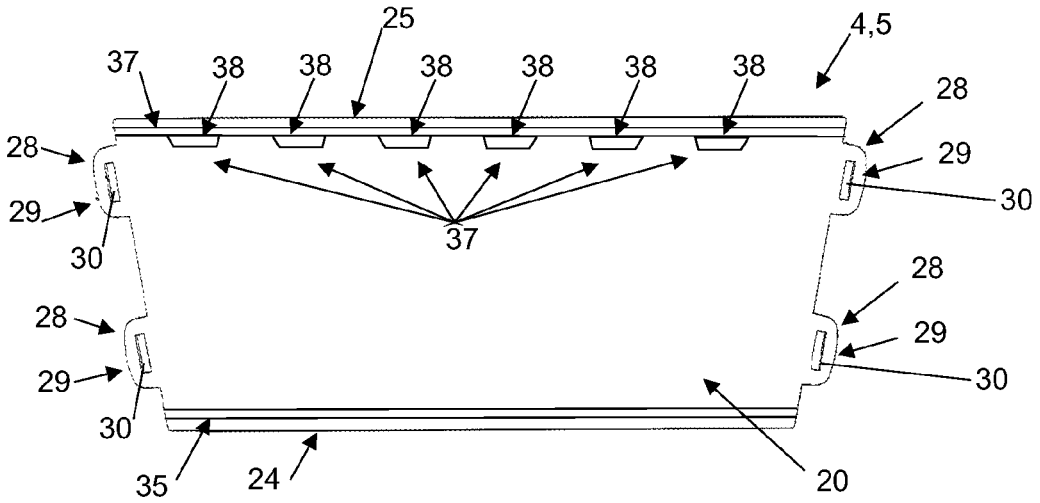
FIG. 3 is an interior side view of a first embodiment of a side panel.
Figure 4:
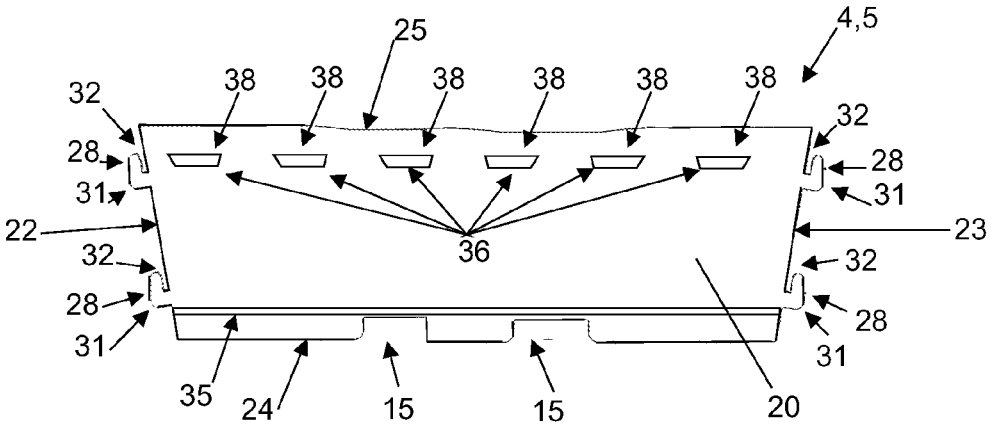
FIG. 4 is an interior side view of a second embodiment of a side panel.

Referring to FIGS. 3 and 4 the inner surface (20) of the side panels (4,5) for the first and second embodiments, respectively, are shown. Each side panel (4,5) includes end edges (22,23) and tension edges (24,25). Said side panels (4,5) are essentially trapezium shaped in this view with the end edges (22,23) being the non-parallel sides of the trapezium. When the coffin (1) or container is assembled one end panel (2,3) lies immediately adjacent each end edge (22,23).

Each end edge (22,23) has two engaging features (28), each located close to a vertex of the side panel (4,5). In the first embodiment the engaging features (28) are tabs (29) which include first locking apertures (30), and in the second embodiment they are hooks (31) which include second locking apertures (32), where the second locking apertures (32) are the open section of the hook commencing at the hook throat and terminating at the exposed surface of the hook. In the second embodiment the hook throat is shown uppermost however in some embodiments (not shown) the hook throat may face downwards.

Each side panel (4,5) includes one or more tension panel support (35,36,37) located in or attached to an inner surface (20) of the side panel (4,5).

In the both FIGS. 3 and 4 the lowermost tension panel support, the primary tension panel support (35), is a longitudinal groove or channel cut into the inner surface (20) of the side panel (4,5). The primary tension panel support (35) runs adjacent to, but separated from, the primary tension edge (24). The primary tension panel support (35) is dimensioned to accept an edge of the primary tension panel (6).

In the second embodiment, FIG. 4, the uppermost tension panel support, the secondary tension panel support (36), is a plurality of small shelves that are fixed to, and extend away from, the inner surface (20) of the side panel (4,5). When in place the secondary tension panel(s) (7,8,9) sit on an exposed face (38) of one or more of these secondary tension panel supports (36).

In the first embodiment of the side panels (FIG. 3), the uppermost tension support, an alternative secondary tension panel support (37), consists of both a groove cut into the inner surface (20) of the side panel (4,5) and a plurality of small shelves similar to the second embodiment. By using a combination of groove and shelves the secondary tension panel(s) (7,8,9) are prevented from being inserted too deeply into the cavity (10) when being inserted into the groove.

In some embodiments the alternative secondary tension panel support (37) will simply be a groove or channel cut into the surface of the side panel (4,5).

Where the tension support (35,36,37) is, or includes, a groove cut into the inner surface (20) of the side panel (4,5) it is unlikely to be more than 50% of the thickness of the side panel (4,5) deep. For a 2.1 m long coffin (1) using 9 mm, 5 ply, plywood a groove depth of 4 mm has been found satisfactory.

It should be noted that the tension edges (24,25) are likely to be curves rather than straight lines, and they may not be parallel to each other; this is because when the coffin (1) or container is in the assembled condition the tension panels (6,7,8,9) bend the side panels (4,5) out from the centre of the coffin (1) or container. This bend deforms the side panel (4,5) and if the tension edges (24,25) and tension panel supports (35,36,37) were straight then the primary and secondary tension panels (6,7,8,9) would not sit in, or on all of, the tension panel supports (35,36,37), and the exposed edges of the coffin (1) or container would not be straight once assembled. This is the reason that the term 'essentially trapezium shaped' is used. It is meant to mean that two of the edges, the normally parallel and straight edges, are in fact most likely to be curved and potentially not parallel.

The side panels (4,5) are likely to be 3 ply to 7 ply plywood between 3 mm and 18 mm thick depending on the length of the coffin (1) or container. Though materials with similar properties may also be usable, timber or timber products are preferred. These timber products include for example clear wood, finger jointed timber, strandboard, medium density fibreboard or similar. Noting that if the container is large then the thickness may exceed 18 mm and if thin materials are used strips of material forming a channel on the inner surface (20) may replace a groove as the tension panel support (35,36,37). The channel may, for example, be created by using pre-milled or formed material or by attaching two parallel strips of thin material to the inner surface (20). As the side panels (4,5) in the assembled coffin (1) or container are deformed by the tension panels (6,7) their thickness and properties is important.

Figure 5:
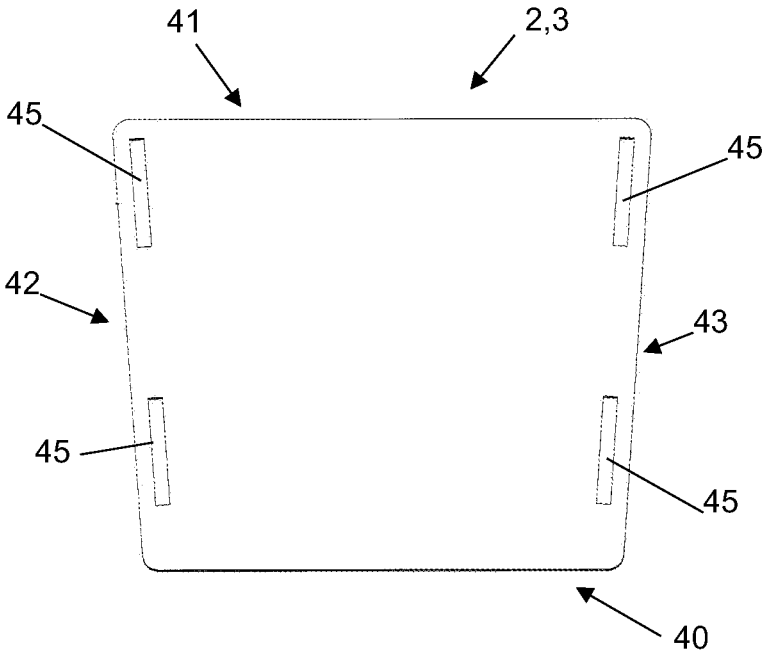
FIG. 5 is a front view of an end panel (either head or tail end panel)

Referring to FIG. 5 the end panels (2,3) including a primary end edge (40), a secondary end edge (41) and two end side edges (42,43) are shown. Each end panel (2,3) is a trapezium with one pair of parallel straight sides (the end edges (40,41)), and two angled sides (the end side edges (42,43)), such that each end panel is essentially a truncated isosceles or equilateral triangle with the base (the secondary end edge (41)) uppermost. Each end panel (2,3) includes four end panel apertures (45) which are rectangular apertures through the respective end panel (2,3), each end panel aperture (45) is dimensioned to accept a matching engaging feature (28). In this case the base of each end panel aperture (45) is essentially parallel to, but inset from, the adjacent end side edge (42,43).

Figure 6:
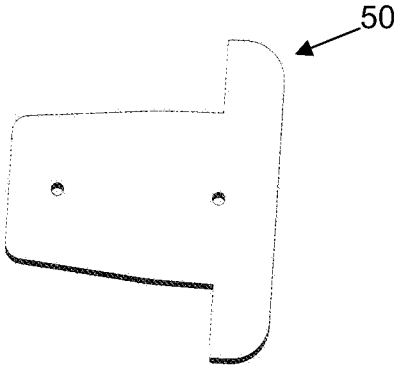
FIG. 6 is a plan view of one embodiment of a locking means.

Referring to FIG. 6 a locking means (50) in the form of a drift is shown. In this particular form each locking means is a 'T' shaped panel with a tapered support leg. The maximum width of the support leg is preferably a snug or interference fit with the complementary locking aperture (30,32). Though shown as a drift the locking means (50) could be a strip of material, tapered or not, a strip with apertures dimensioned and configured to align with and be retained in said locking aperture or apertures (30,32), or they could also be a simply tapered panel. Each locking means (50) is configured to co-operate with one or more locking aperture (30,32) to prevent the end panels (2,3) from disengaging with the side panels (4,5) when the coffin (1) or container is assembled and the tension panels (6,7,8,9) are put in place.

Figure 7:
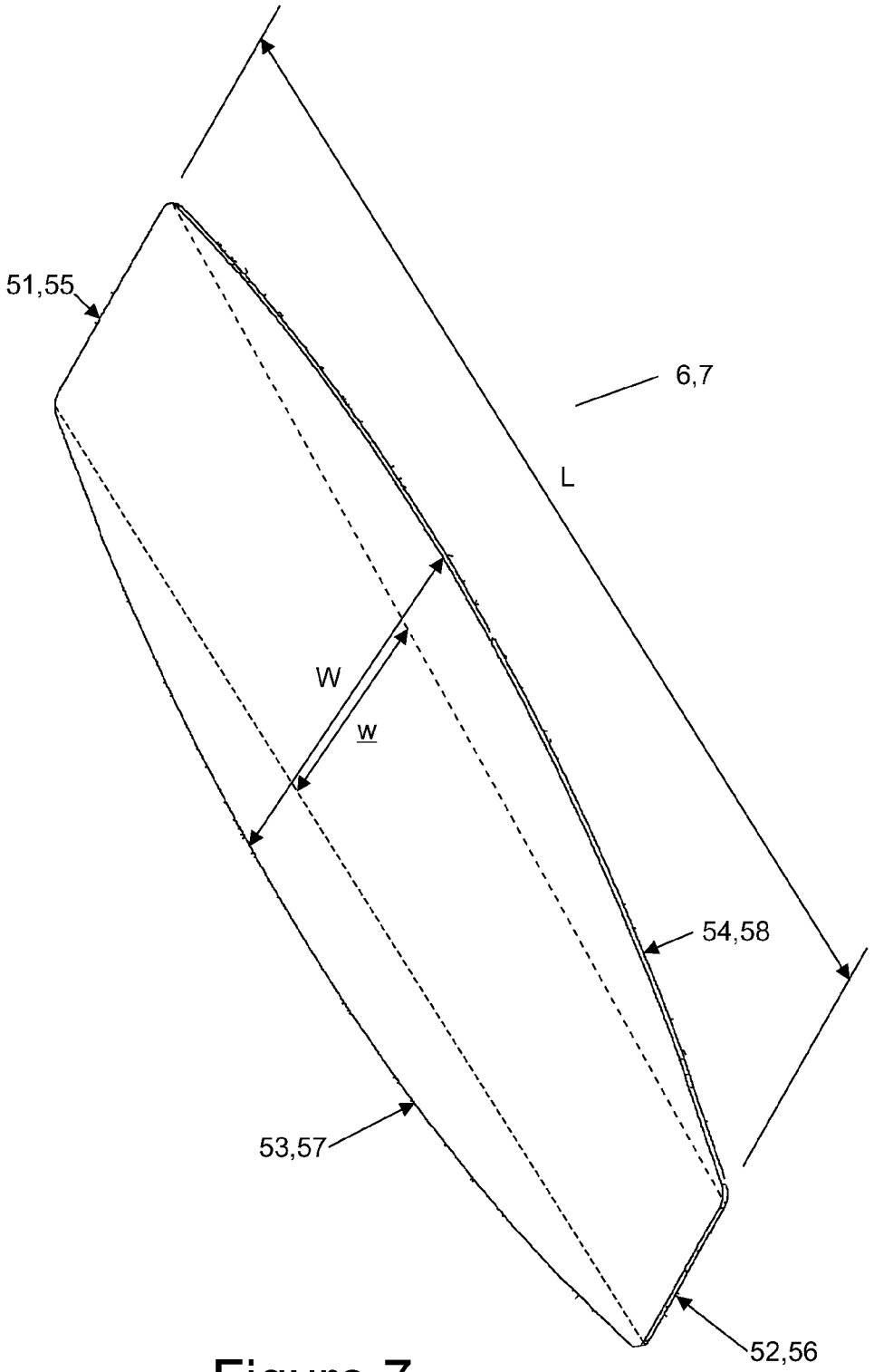
FIG. 7 is a pictorial view of a primary tension panel.

FIG. 7 shows a primary tension panel (6) with two primary tension panel ends (51,52) and two primary tension panel sides (53,54), or unitary secondary tension panel (7) with two secondary tension panel ends (55,56) and two secondary tension panel sides (57,58). The tension panel ends (51,52,55,56) are essentially parallel and straight, the tension panel sides (53,54,57,58) are convex and symmetrical about the lengthwise centreline. To apply the correct amount of tension the following formula is applied:

$$\%\ \text{tension}=((W-\underline{w})/L)\times 100\%$$

where

W=width of the tension panel (6,7,8,9) at widest part of tension panel (6,7,8,9);

$\underline{w}$=a distance between a pair of straight lines at the same location as W, where each straight line joins lengthwise adjacent vertices of the tension panel (6,7,8,9) (that is said straight lines do not cross);

L=the length of the tension panel;

% tension=1% to 18%.

The % tension may for some materials be higher than 18% but this figure is believed to be the maximum for plywood. For 9 mm, 5 ply plywood, 7% over a length of 2.1 m has been found successful.

The widest point across a unitary tension panel (6,7) is expected to be between 25% and 75% of the length from one tension panel end (51,52,55,56) so that good contact between the adjacent tension panel side (53,54,57,58) and the inner surface (20) of the side panel (4,5), or base of any groove in said side panel (4,5), is maintained in the as assembled condition. In some configurations intermittent or single point contact may be sufficient.

A multi-part secondary tension panel (8,9) locates the widest part of the combined sections at the same point as a unitary tension panel (6,7), that is between 25% and 75% of the length from one assembled or unitary secondary tension panel end (55,56).

Though the primary tension panel sides (53,54) are described as curves, for some embodiments they may be two or more line segments and still perform the same task.

Figure 8:
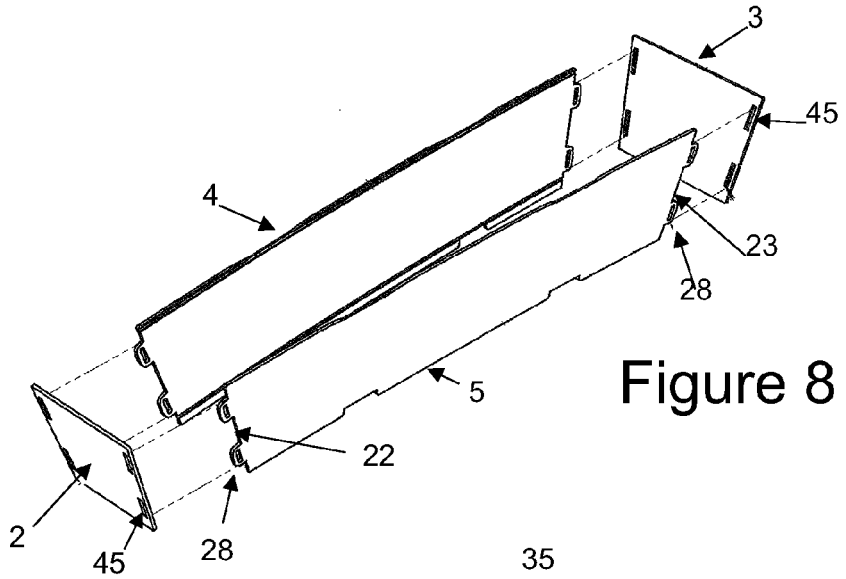
FIGS. 8 through 12 are pictorial views showing the preferred method of assembling a coffin.
Figure 9:
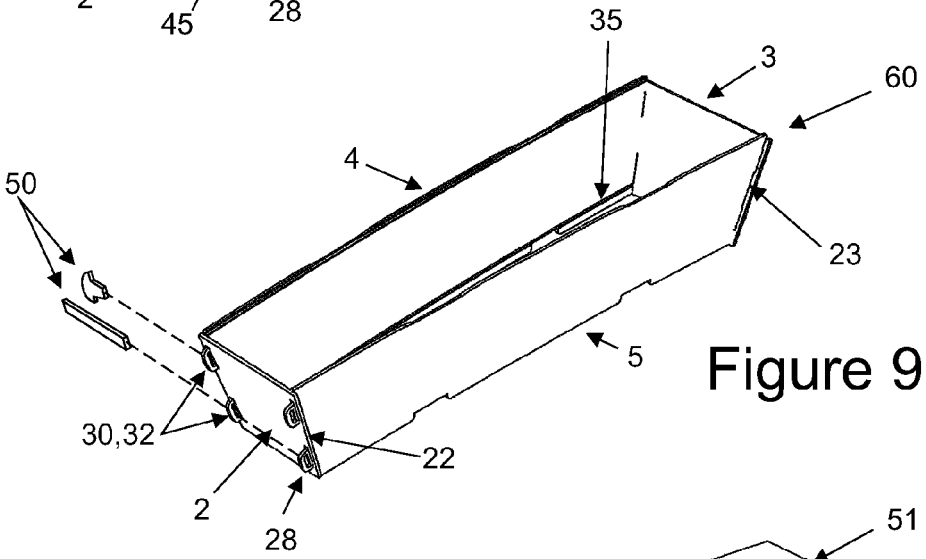
Figure 10:
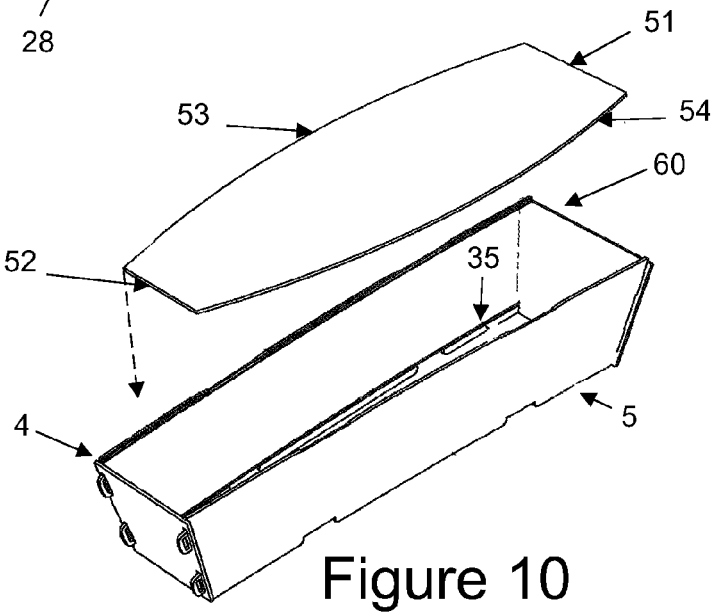
Figure 11:
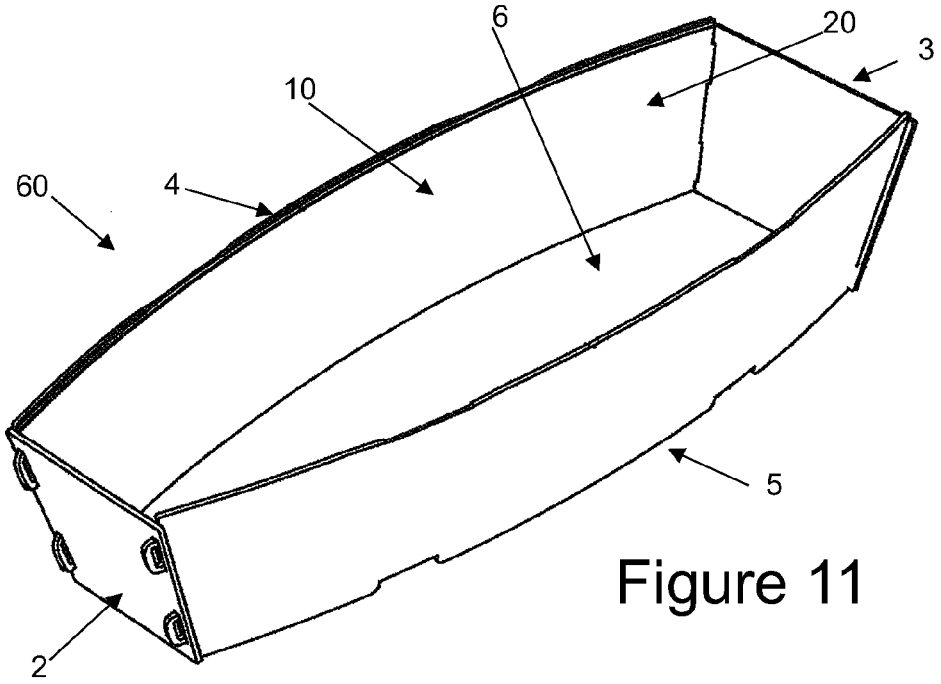
Figure 12:
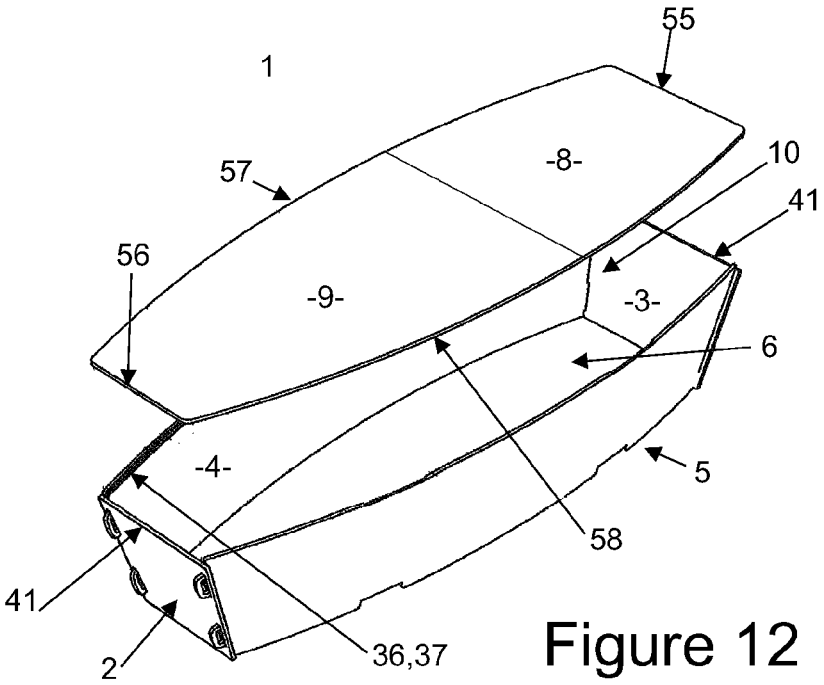

A preferred method of assembling a coffin (1) is shown in FIGS. 8 to 12 where:

FIG. 8 shows the end panels (2,3) and side panels (4,5) being assembled to form a wall (60);

FIG. 9 shows the assembled wall (60);

FIG. 10 shows the primary tension panel (6) being inserted into the wall (60);

FIG. 11 shows the primary tension panel (6) in place and the cavity (10) formed;

FIG. 12 shows a two part secondary tension panel (7,8,9) being inserted to form a closed coffin (1).

Please note that for clarity not all of the items mentioned are numbered in FIGS. 8 to 12, it is believed that it will be clear to the reader which features are the same as those specifically numbered.

In FIG. 8 a first step is undertaken, in this step the engaging features (28) are inserted through a complementary end panel aperture (45) until the end edge (22,23) is in contact with the surface of the end panel (2,3) forming, as shown in FIG. 9, a continuous wall (60).

In FIG. 9 the wall (60) formed by inserting the engaging features (28) through complementary end panel apertures (45) is shown. In this position a suitable locking means (50) is inserted into a complementary locking aperture (30,32). If the locking means (50) is a drift then it is pushed through the locking aperture (30,32) until it is positively engaged, if the locking means (50) is a bar or strip of material then it is inserted into or through one or more locking apertures (30,32).

In some configurations, where some or all of the engaging means (28) are hooks (31), the end panel aperture (45) may engage directly with the associated end panel (2,3).

In FIG. 10 the first primary tension panel side (53) is inserted into the void formed by the walls (60) to engage with the primary tension panel support (35), which in this case is a groove, in the first side panel (4). The second primary tension panel side (54) is then pushed down into the void until it engages with the primary tension panel support (35) in the first side panel (5) causing the primary tension panel (6) to deform the side panels (4,5) and apply tension to the wall (60) forming a rigid (or at least semi-rigid) structure with a cavity (10), as shown in FIG. 11.

In FIG. 11 the coffin (1) or container is shown without a secondary tension panel (s) (7,8,9) in place. For some applications this may be the final form, but in most cases a secondary tension panel(s) (7,8,9) will be inserted to fully enclose the cavity (10).

FIG. 12 shows a two part secondary tension panel (8,9) being inserted. First the section of the first secondary tension panel side (57) that is part of the second secondary tension panel (9) is engaged with the relevant section of the secondary tension panel support (36,37) in the first side panel (4), which in this case is a groove without any shelves. Then the second secondary tension panel side (58) that is part of the second secondary tension panel (9) is engaged with the relevant section of the secondary tension panel support (36,37) in the second side panel (5). Once in place the second secondary tension panel end (56) should be immediately adjacent, and the second secondary tension panel (9) should be in contact with, the secondary end edge (41) of the first end panel (2); this may involve sliding the second secondary tension panel (9) into place. In this form the coffin (1) has a viewing aperture which may be useful for identification purposes. After the second secondary tension panel (9) has been inserted the first secondary tension panel (8) can be inserted and a fully closed coffin (1) or container is formed.

Figure 13:
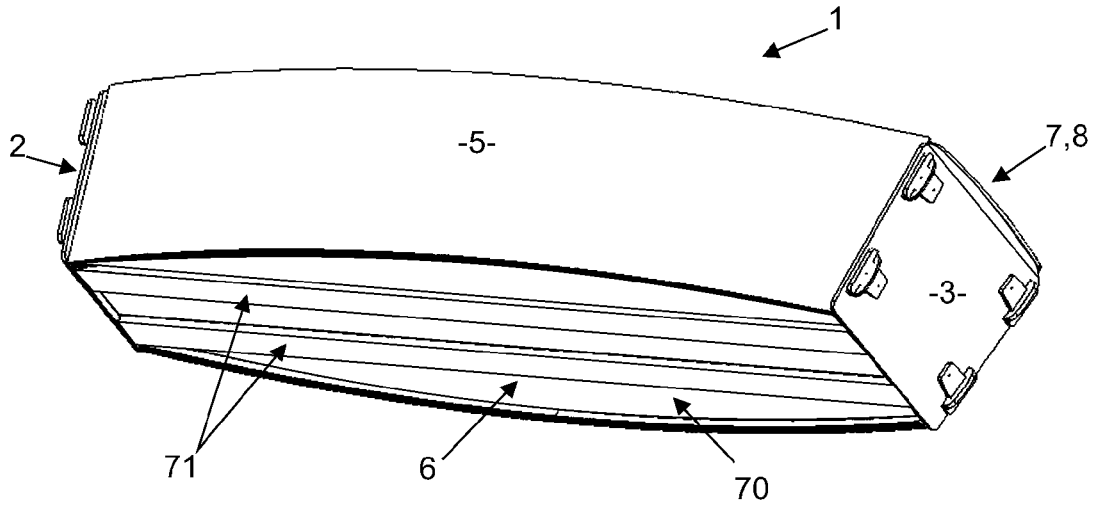
FIG. 13 is a pictorial view of the coffin with bearing strips shown.

Referring to FIG. 13 a third embodiment of the coffin (1) is shown. In this embodiment the external surface (70) of the primary tension panel (6) including a plurality of bearing strips (71) is shown. Said bearing strips (71) are flat bars of material that run the length of the primary tension panel (6), the bearing strips (71) are thick enough so that they and the primary tension edges (24), or they alone, support the coffin (1) or container. These bearing strips provide strength and rigidity to the primary tension panel (6) and a surface to engage with the ground or rollers/belt of a conveyer.

Figure 14:
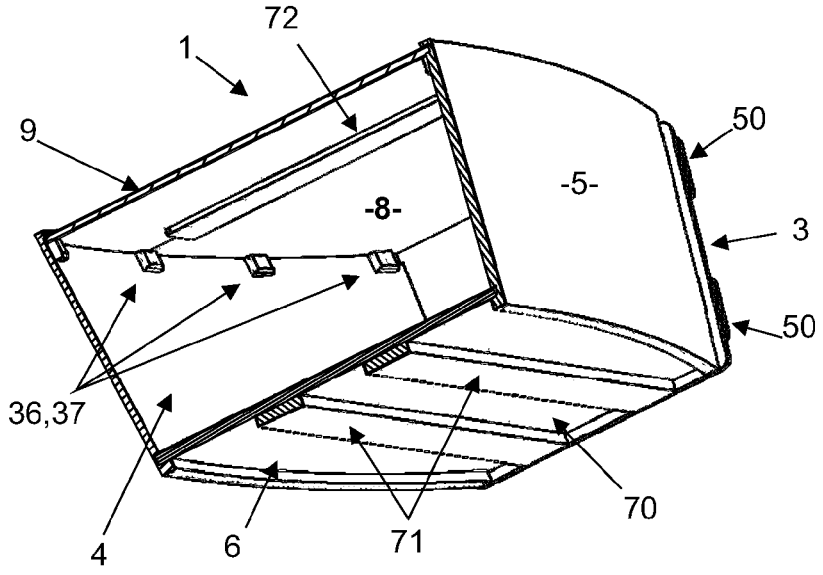
FIG. 14 is pictorial cross sectional view of the coffin shown in FIG. 13

FIG. 14 shows a cross sectional pictorial view of the third embodiment looking at the join between the first and second secondary tension panels (8,9). In this embodiment the second secondary tension panel (9) includes a support shelf (72) that is a thin strip of material attached to an inner surface of the second secondary tension panel (9), that provides support for the first secondary tension panel (8) when it is inserted. This support shelf (72) has been found to make the assembly of a coffin (1) much quicker as it prevents the first secondary tension panel (8) from being inserted too deeply into the cavity (10). One method of inserting the first secondary tension panel into place involves butting it up against the already inserted second secondary tension panel (9) by sliding it along the support shelf (72), then pushing it down into contact with the exposed face (38) of each of the alternative secondary tension panel supports (37), which includes shelves and a groove, forcing it to engage with the groove.

It should be noted that in some embodiments the secondary tension panel(s) (7,8,9) and primary tension panel (6) may in fact be side faces of the container or coffin (1), and the end panels (2,3) or side panels (4,5) are the uppermost and lowermost faces of the coffin (1) or container. This orientation allows side access to the cavity (10) which may be preferable if the container is large.

In some embodiments (not shown) there is a mixture of engaging features (28) present, for example downward facing hooks (31) at the bottom and tabs (29) at the top so that the hooks (31) are engaged with the lower end panel apertures (45) and the tabs (29) swung through the uppermost end panel apertures (45).

In some embodiments the end panels (2,3) may be essentially rectangular or have a shape similar to a truncated triangle (scalene, isosceles or equilateral), inverted or not. Further the dimensions and configuration of each end panel (2,3) may be different to the other end panel (2,3).

KEY

1. Coffin;
2. First end panel;
3. Second end panel;
4. First side panel;
5. Second side panel;
6. Primary tension panel;
7. Secondary tension panel;
8. First secondary tension panel;
9. Second secondary tension panel;
10. Cavity;
15. Recesses;
20. Inner surface of first side panel;
21.;
22. First end edge;
23. Second end edge;
24. Primary tension edge;
25. Secondary tension edge;
28. Engaging features;
29. Tabs;
30. First locking apertures;
31. Hooks;
32. Second locking apertures;

35. Tension panel support (primary tension panel support);
36. Tension panel support (secondary tension panel support—shelves only);
37. Tension panel support (alternative secondary tension panel support);
38. Exposed face (of each small shelf);
40. Primary end edge (lowermost edge of end for coffin (1));
41. Secondary end edge (uppermost edge of end for coffin (1));
42. End side edge;
43. End side edge;
44.;
45. End panel aperture (each engaging feature passes through one);
50. Locking means (in the form of a drift or anything else suitable);
51. First primary tension panel end;
52. Second primary tension panel end;
53. First primary tension panel side;
54. Second primary tension panel side;
55. First secondary tension panel end;
56. Second secondary tension panel end;
57. First secondary tension panel side;
58. Second secondary tension panel side;
60. Wall (formed from the end panels and side panels);
70. External surface of the primary tension panel, for the third embodiment;
71. Bearing strips;
72. Support Shelf.

The invention claimed is:

1. A coffin or container that is erected or assembled from a substantially knock down or flat state, which includes:—
a primary tension panel;
a pair of side panels; and
a pair of end panels;
wherein, in an assembled form, an end of each said side panel is releasably attached to each end panel via complementary engaging features on each side panel to define a substantially quadrilateral wall, such that said primary tension panel, when located substantially within said wall, places at least said side panels in tension to thereby retain said primary tension panel within said wall and define, at least in part, a cavity; such that the amount of tension applied by the primary tension panel is determined by the following formula:

$$\%\ \text{tension}=((W-w)/L)\times 100\%$$

where
W=a width of the tension panel at a widest part of the tension panel;
w=a distance between a pair of straight lines at the same location as W, where each straight line joins lengthwise adjacent vertices of the tension panel;
L=a length of the tension panel; and
% tension=1% to 18%.

2. The coffin or container as claimed in claim 1 wherein, the primary tension panel includes two primary tension panel sides configured to apply the tension to the side panels.

3. The coffin or container as claimed in claim 2 wherein, said primary tension panel sides are convex curves.

4. The coffin or container as claimed in claim 1 wherein, said primary tension panel is located close to, and is approximately aligned with, a primary tension edge of each side panel, where the primary tension edge of each side panel is located on a first face of the coffin or container.

5. The coffin or container as claimed in claim 1 wherein, the coffin or box includes a unitary secondary tension panel or a split secondary tension panel.

6. The coffin or container as claimed in claim 5 wherein, said secondary tension panel, when located substantially within said wall, places at least said side panels in tension to thereby retain said secondary tension panel within said wall and act as a full or partial lid, cover or door for the cavity.

7. The coffin or container as claimed in claim 5 wherein, the secondary tension panel includes two secondary tension panel sides configured to apply the tension to the side panels.

8. The coffin or container as claimed in claim 7 wherein, said secondary tension panel sides are convex curves.

9. The coffin or container as claimed in claim 5 wherein, the widest point of the unitary secondary tension panel is located at or between 25% and 75% of the length of the tension panel.

10. The coffin or container as claimed in claim 5 wherein, the amount of tension applied by the unitary secondary tension panel is determined by the following formula:

$$\%\ \text{tension}=((W-\underline{w})/L)\times 100\%$$

where
W=a width of the tension panel at a widest part of the tension panel;
$\underline{w}$=a distance between a pair of straight lines at the same location as W, where each straight line joins lengthwise adjacent vertices of the tension panel;
L=a length of the tension panel;
% tension=1% to 18%.

11. The coffin or container as claimed in claim 1 wherein, a widest point of the primary tension panel is located at or between 25% and 75% of the length of the tension panel.

12. The coffin or container as claimed in claim 1 wherein, each side panel includes a primary tension panel support for the primary tension panel.

13. The coffin or container as claimed in claim 12 wherein, the tension panel support is a groove or channel cut into an inner surface of the side panel.

14. The coffin or container as claimed in claim 13 wherein, the depth of the groove is less than 50% of the thickness of the side panel.

15. A method of making a container or coffin which includes the following steps:
construct an essentially quadrilateral wall from a pair of end panels and a pair of side panels;
insert a first primary tension side of a primary tension panel into a matching primary tension panel support in a first side panel;
push a second primary tension panel side of the primary tension panel into a matching primary tension panel support in a second side panel deforming each side panel and applying tension to at least the side panels;
wherein the amount of tension applied by the primary tension panel is determined by the following formula:

$$\%\ \text{tension}=((W-\underline{w})/L)\times 100\%$$

where
W=a width of the tension panel at a widest part of the tension panel;
$\underline{w}$=a distance between a pair of straight lines at the same location as W, where each straight line joins lengthwise adjacent vertices of the tension panel;
L=a length of the tension panel; and
% tension=1% to 18%.

16. The method as claimed in claim 15 wherein, the method it further includes the following steps:

insert a first secondary tension side of a first secondary tension panel into a matching secondary tension panel support in the first side panel;

insert a second secondary side of the first secondary tension panel into a matching secondary tension panel support in the second side panel and move the first secondary tension panel until it is in contact with an edge of an end panel.

17. The method as claimed in claim 16 wherein, the method it further includes the following steps:

rest a second secondary tension panel against a support shelf on the first secondary tension panel and insert a first secondary tension side of the second secondary tension panel into a matching secondary tension panel support in the first side panel;

insert a second secondary side of the second secondary tension panel into a matching secondary tension panel support in the second side panel and move the second secondary tension panel until it is in contact with the first secondary tension panel.

* * * * *